US008327885B2

(12) United States Patent
Dykstra et al.

(10) Patent No.: US 8,327,885 B2
(45) **Date of Patent: *Dec. 11, 2012**

(54) FLOW PATH CONTROL BASED ON FLUID CHARACTERISTICS TO THEREBY VARIABLY RESIST FLOW IN A SUBTERRANEAN WELL

(75) Inventors: Jason D. Dykstra, Carrollton, TX (US); Michael L. Fripp, Carrollton, TX (US); Syed Hamid, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/111,169

(22) Filed: May 19, 2011

(65) Prior Publication Data

US 2011/0214876 A1 Sep. 8, 2011

Related U.S. Application Data

(63) Continuation of application No. 12/791,993, filed on Jun. 2, 2010, now Pat. No. 8,235,128, which is a continuation-in-part of application No. 12/700,685, filed on Feb. 4, 2010, which is a continuation-in-part of application No. 12/542,695, filed on Aug. 18, 2009, now abandoned.

(51) Int. Cl.
*F15C 1/16* (2006.01)
*E21B 43/12* (2006.01)

(52) U.S. Cl. ..... 137/810; 166/316; 166/373; 137/815; 137/837

(58) Field of Classification Search ..... 137/804, 137/805, 810, 812, 815, 823, 837, 838, 813; 166/316, 373
See application file for complete search history.

(56) References Cited

U.S. PATENT DOCUMENTS 2,324,819 A 6/1941 Butzbach
3,091,393 A 5/1963 Sparrow
3,216,439 A 11/1965 Manion
(Continued)

FOREIGN PATENT DOCUMENTS

EP 0834342 A2 4/1998
(Continued)

OTHER PUBLICATIONS

Joseph M. Kirchner, "Fluid Amplifiers", 1996, 6 pages, McGraw-Hill, New York.

(Continued)

*Primary Examiner* — Giovanna Wright
(74) *Attorney, Agent, or Firm* — Smith IP Services, P.C.

(57) ABSTRACT

A system for variably resisting flow of a fluid composition can include a flow passage and a set of one or more branch passages which intersect the flow passage, whereby a proportion of the fluid composition diverted from the passage to the set of branch passages varies based on at least one of a) viscosity of the fluid composition, and b) velocity of the fluid composition in the flow passage. Another variable flow resistance system can include a flow path selection device that selects which of multiple flow paths a majority of fluid flows through from the device, based on a ratio of desired fluid to undesired fluid in the fluid composition. Yet another variable flow resistance system can include a flow chamber, with a majority of the fluid composition entering the chamber in a direction which changes based on a ratio of desired fluid to undesired fluid in the fluid composition.

43 Claims, 9 Drawing Sheets

U.S. PATENT DOCUMENTS

| | | | | | |
|---|---|---|---|---|---|
| 3,233,621 | A | | 2/1966 | Manion | |
| 3,256,899 | A | | 6/1966 | Dexter et al. | |
| 3,282,279 | A | | 11/1966 | Manion | |
| 3,461,897 | A | | 8/1969 | Kwok | |
| 3,470,894 | A | | 10/1969 | Rimmer | |
| 3,474,670 | A | | 10/1969 | Rupert | |
| 3,489,009 | A | | 1/1970 | Rimmer | |
| 3,515,160 | A | | 6/1970 | Cohen | |
| 3,529,614 | A | | 9/1970 | Nelson | |
| 3,537,466 | A | | 11/1970 | Chapin | |
| 3,566,900 | A | | 3/1971 | Black | |
| 3,586,104 | A | | 6/1971 | Hyde | |
| 3,598,137 | A | | 8/1971 | Glaze | |
| 3,620,238 | A | * | 11/1971 | Kawabata | 137/810 |
| 3,670,753 | A | | 6/1972 | Healey | |
| 3,704,832 | A | | 12/1972 | Fix et al. | |
| 3,712,321 | A | | 1/1973 | Bauer | |
| 3,717,164 | A | | 2/1973 | Griffin | |
| 3,942,557 | A | | 3/1976 | Tsuchiya | |
| 4,029,127 | A | | 6/1977 | Thompson | |
| 4,082,169 | A | | 4/1978 | Bowles | |
| 4,127,173 | A | | 11/1978 | Watkins et al. | |
| 4,276,943 | A | | 7/1981 | Holmes | |
| 4,286,627 | A | | 9/1981 | Graf | |
| 4,291,395 | A | | 9/1981 | Holmes | |
| 4,307,653 | A | * | 12/1981 | Goes et al. | 89/198 |
| 4,323,991 | A | * | 4/1982 | Holmes et al. | 367/83 |
| 4,385,875 | A | | 5/1983 | Kanazawa | |
| 4,418,721 | A | | 12/1983 | Holmes | |
| 4,557,295 | A | * | 12/1985 | Holmes | 137/813 |
| 4,919,204 | A | | 4/1990 | Baker et al. | |
| 5,184,678 | A | | 2/1993 | Pechkov et al. | |
| 5,455,804 | A | | 10/1995 | Holmes et al. | |
| 5,484,016 | A | | 1/1996 | Surjaatmadja et al. | |
| 5,505,262 | A | | 4/1996 | Cobb | |
| 5,533,571 | A | | 7/1996 | Surjaatmadja et al. | |
| 6,015,011 | A | | 1/2000 | Hunter | |
| 6,241,019 | B1 | | 6/2001 | Davidson et al. | |
| 6,336,502 | B1 | | 1/2002 | Surjaatmadja et al. | |
| 6,345,963 | B1 | | 2/2002 | Thomin et al. | |
| 6,367,547 | B1 | | 4/2002 | Towers et al. | |
| 6,371,210 | B1 | | 4/2002 | Bode et al. | |
| 6,405,797 | B2 | | 6/2002 | Davidson et al. | |
| 6,497,252 | B1 | | 12/2002 | Kohler et al. | |
| 6,619,394 | B2 | | 9/2003 | Soliman et al. | |
| 6,622,794 | B2 | | 9/2003 | Zisk, Jr. | |
| 6,627,081 | B1 | | 9/2003 | Hilditch et al. | |
| 6,644,412 | B2 | | 11/2003 | Bode et al. | |
| 6,691,781 | B2 | | 2/2004 | Grant et al. | |
| 6,719,048 | B1 | | 4/2004 | Ramos et al. | |
| 6,851,473 | B2 | | 2/2005 | Davidson | |
| 6,913,079 | B2 | | 7/2005 | Tubel | |
| 6,976,507 | B1 | | 12/2005 | Webb et al. | |
| 7,025,134 | B2 | | 4/2006 | Byrd et al. | |
| 7,114,560 | B2 | | 10/2006 | Nguyen et al. | |
| 7,185,706 | B2 | | 3/2007 | Freyer | |
| 7,213,650 | B2 | | 5/2007 | Lehman et al. | |
| 7,213,681 | B2 | | 5/2007 | Birchak et al. | |
| 7,216,738 | B2 | | 5/2007 | Birchak et al. | |
| 7,290,606 | B2 | | 11/2007 | Coronado et al. | |
| 7,318,471 | B2 | | 1/2008 | Rodney et al. | |
| 7,404,416 | B2 | | 7/2008 | Schultz et al. | |
| 7,405,998 | B2 | | 7/2008 | Webb et al. | |
| 7,409,999 | B2 | | 8/2008 | Henriksen et al. | |
| 7,413,010 | B2 | | 8/2008 | Blauch et al. | |
| 7,537,056 | B2 | | 5/2009 | MacDougall | |
| 7,578,343 | B2 | | 8/2009 | Augustine | |
| 7,621,336 | B2 | | 11/2009 | Badalamenti et al. | |
| 8,127,856 | B1 | | 3/2012 | Nish et al. | |
| 2006/0131033 | A1 | | 6/2006 | Bode et al. | |
| 2007/0045038 | A1 | | 3/2007 | Han et al. | |
| 2007/0256828 | A1 | | 11/2007 | Birchak et al. | |
| 2008/0041580 | A1 | | 2/2008 | Freyer et al. | |
| 2008/0041581 | A1 | | 2/2008 | Richards | |
| 2008/0041582 | A1 | | 2/2008 | Saetre et al. | |
| 2008/0041588 | A1 | | 2/2008 | Richards et al. | |
| 2008/0149323 | A1 | | 6/2008 | O'Malley et al. | |
| 2008/0169099 | A1 | | 7/2008 | Pensgaard et al. | |
| 2008/0283238 | A1 | | 11/2008 | Richards et al. | |
| 2009/0008088 | A1 | | 1/2009 | Schultz et al. | |
| 2009/0008090 | A1 | | 1/2009 | Schultz et al. | |
| 2009/0009297 | A1 | | 1/2009 | Shinohara et al. | |
| 2009/0009333 | A1 | | 1/2009 | Bhogal et al. | |
| 2009/0009336 | A1 | | 1/2009 | Ishikawa | |
| 2009/0009412 | A1 | | 1/2009 | Warther | |
| 2009/0009437 | A1 | | 1/2009 | Hwang et al. | |
| 2009/0009445 | A1 | | 1/2009 | Lee | |
| 2009/0009447 | A1 | | 1/2009 | Naka et al. | |
| 2009/0065197 | A1 | | 3/2009 | Eslinger | |
| 2009/0078427 | A1 | | 3/2009 | Patel | |
| 2009/0078428 | A1 | | 3/2009 | Ali | |
| 2009/0101354 | A1 | | 4/2009 | Holmes et al. | |
| 2009/0133869 | A1 | | 5/2009 | Clem | |
| 2009/0151925 | A1 | | 6/2009 | Richards et al. | |
| 2009/0159282 | A1 | | 6/2009 | Webb et al. | |
| 2009/0250224 | A1 | | 10/2009 | Wright et al. | |
| 2009/0277639 | A1 | | 11/2009 | Schultz et al. | |
| 2009/0277650 | A1 | | 11/2009 | Casciaro et al. | |
| 2011/0042091 | A1 | * | 2/2011 | Dykstra et al. | 166/316 |
| 2011/0042092 | A1 | | 2/2011 | Fripp et al. | |
| 2011/0186300 | A1 | | 8/2011 | Dykstra et al. | |
| 2011/0198097 | A1 | | 8/2011 | Moen | |
| 2011/0214876 | A1 | | 9/2011 | Dykstra et al. | |
| 2011/0297384 | A1 | * | 12/2011 | Fripp et al. | 166/316 |
| 2012/0060624 | A1 | | 3/2012 | Dykstra | |

FOREIGN PATENT DOCUMENTS

| | | | |
|---|---|---|---|
| EP | 1857633 | A2 | 11/2007 |
| WO | 0214647 | A1 | 2/2002 |
| WO | 03062597 | A1 | 7/2003 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |

OTHER PUBLICATIONS

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Specification and Drawings for U.S. Appl. No. 12/792,095, filed Jun. 2, 2010, 29 pages.

Specification and Drawings for U.S. Appl. No. 10/650,186, filed Aug. 28, 2003, 16 pages.

Apparatus and Method of Inducing Fluidic Oscillation in a Rotating Cleaning Nozzle, ip.com, dated Apr. 24, 2007, 3 pages.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

Office Action issued Jun. 27, 2011, for U.S. Appl. No. 12/791,993, 17 pages.
Stanley W. Angrist; "Fluid Control Devices", Scientific American Magazine, dated Dec. 1964, 8 pages.
Rune Freyer et al.; "An Oil Selective Inflow Control System", Society of Petroleum Engineers Inc. paper, SPE 78272, dated Oct. 29-31, 2002, 8 pages.
Office Action issued Nov. 2, 2011 for U.S. Appl. No. 12/792,146, 34 pages.
Office Action issued Nov. 2, 2011 for U.S. Appl. No. 12/792,117, 35 pages.
Stanley W. Angrist; "Fluid Control Devices", published Dec. 1964, 5 pages.
Specification and Drawings for Continuation Patent Application, U.S. Appl. No. 13/495,078, filed Jun. 13, 2012, 39 pages.
Australian Office Action issued Apr. 5, 2012 for AU Patent Application No. 2010284478, 2 pages.
Specification and Drawings for U.S. Appl. No. 12/542,695, filed Aug. 18, 2009, 32 pages.
International Search Report with Written Opinion issued Aug. 3, 2012 for PCT Patent Application No. PCT/US11/059530, 15 pages.
International Search Report with Written Opinion issued Aug. 3, 2012 for PCT Patent Application No. PCT/US11/059534, 14 pages.
Office Action issued Jul. 25, 2012 for U.S. Appl. No. 12/881,296, 61 pages.
International Search Report with Written Opinion dated Aug. 31, 2012 for PCT Patent Application No. PCT/US11/060606, 10 pages.
Office Action issued Sep. 10, 2012 for U.S. Appl. No. 12/792,095, 59 pages.
Office Action issued Sep. 19, 2012 for U.S. Appl. No. 12/879,846, 78 pages.
Office Action issued Sep. 19, 2012 for U.S. Appl. No. 13/495,078, 29 pages.

* cited by examiner

FLOW PATH CONTROL BASED ON FLUID CHARACTERISTICS TO THEREBY VARIABLY RESIST FLOW IN A SUBTERRANEAN WELL

CROSS-REFERENCE TO RELATED APPLICATIONS

This application is a continuation of U.S. application Ser. No. 12/791,993 filed on Jun. 2, 2010, which is a continuation-in-part of prior application Ser. No. 12/700,685 filed on 4 Feb. 2010, which is a continuation-in-part of application Ser. No. 12/542,695 filed on 18 Aug. 2009. The entire disclosures of these prior applications are incorporated herein by this reference for all purposes.

BACKGROUND

This disclosure relates generally to equipment utilized and operations performed in conjunction with a subterranean well and, in an example described below, more particularly provides for flow path control based on fluid characteristics to thereby variably resist flow in a subterranean well.

In a hydrocarbon production well, it is many times beneficial to be able to regulate flow of fluids from an earth formation into a wellbore. A variety of purposes may be served by such regulation, including prevention of water or gas coning, minimizing sand production, minimizing water and/or gas production, maximizing oil and/or gas production, balancing production among zones, etc.

In an injection well, it is typically desirable to evenly inject water, steam, gas, etc., into multiple zones, so that hydrocarbons are displaced evenly through an earth formation, without the injected fluid prematurely breaking through to a production wellbore. Thus, the ability to regulate flow of fluids from a wellbore into an earth formation can also be beneficial for injection wells.

Therefore, it will be appreciated that advancements in the art of variably restricting fluid flow in a well would be desirable in the circumstances mentioned above, and such advancements would also be beneficial in a wide variety of other circumstances.

SUMMARY

In the disclosure below, a variable flow resistance system is provided which brings improvements to the art of regulating fluid flow in a well. One example is described below in which a fluid composition is made to flow along a more resistive flow path if the fluid composition has a threshold level (or more than the threshold level) of an undesirable characteristic. Another example is described below in which a resistance to flow through the system increases as a ratio of desired fluid to undesired fluid in the fluid composition decreases.

In one aspect, a system for variably resisting flow of a fluid composition in a subterranean well is provided by the disclosure. The system can include a flow passage and a set of one or more branch passages which intersect the flow passage. In this manner, a proportion of the fluid composition diverted from the flow passage to the set of branch passages varies based on at least one of a) viscosity of the fluid composition, and b) velocity of the fluid composition in the flow passage.

In another aspect, a system for variably resisting flow of a fluid composition in a subterranean well is described. The system can include a flow path selection device that selects which of multiple flow paths a majority of fluid flows through from the device, based on a ratio of desired fluid to undesired fluid in the fluid composition.

In yet another aspect, a system for variably resisting flow of a fluid composition can include a flow chamber. A majority of the fluid composition enters the chamber in a direction which changes based on a ratio of desired fluid to undesired fluid in the fluid composition.

In a further aspect, the present disclosure provides a system for variably resisting flow of a fluid composition in a subterranean well. The system can include a flow chamber, and a majority of the fluid composition can enter the chamber in a direction which changes based on a velocity of the fluid composition.

In a still further aspect, a variable flow resistance system for use in a subterranean well can include a flow chamber having an outlet, and at least first and second inlets. A fluid composition which enters the flow chamber via the second inlet can oppose flow of the fluid composition which enters the flow chamber via the first inlet, whereby a resistance to flow of the fluid composition through the flow chamber can vary with a ratio of flows through the first and second inlets.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
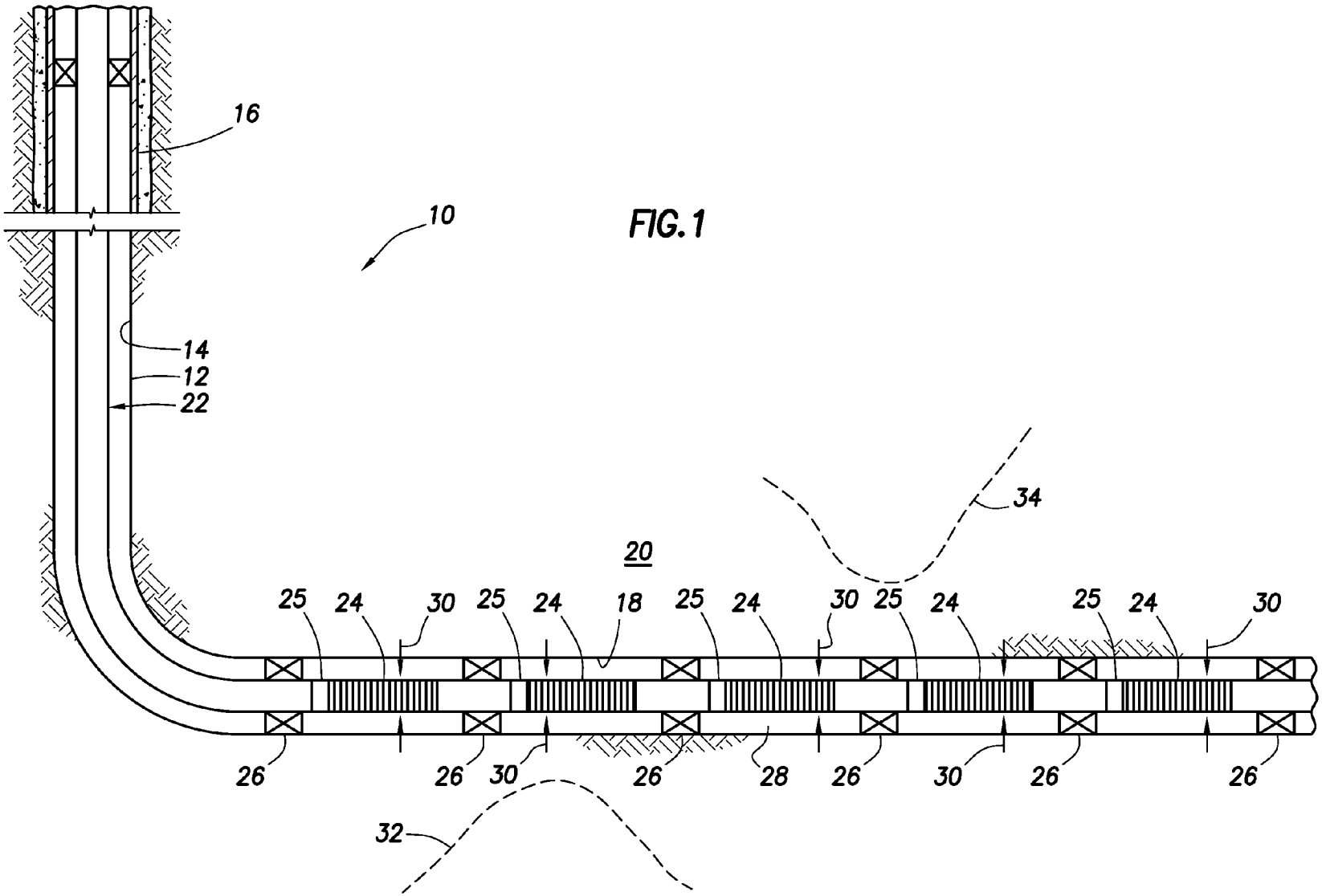
FIG. 1 is a schematic partially cross-sectional view of a well system which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, the principles of this disclosure can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), increasing resistance to flow if a fluid viscosity decreases below a selected level or if a fluid density increases above a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid in a fluid composition.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
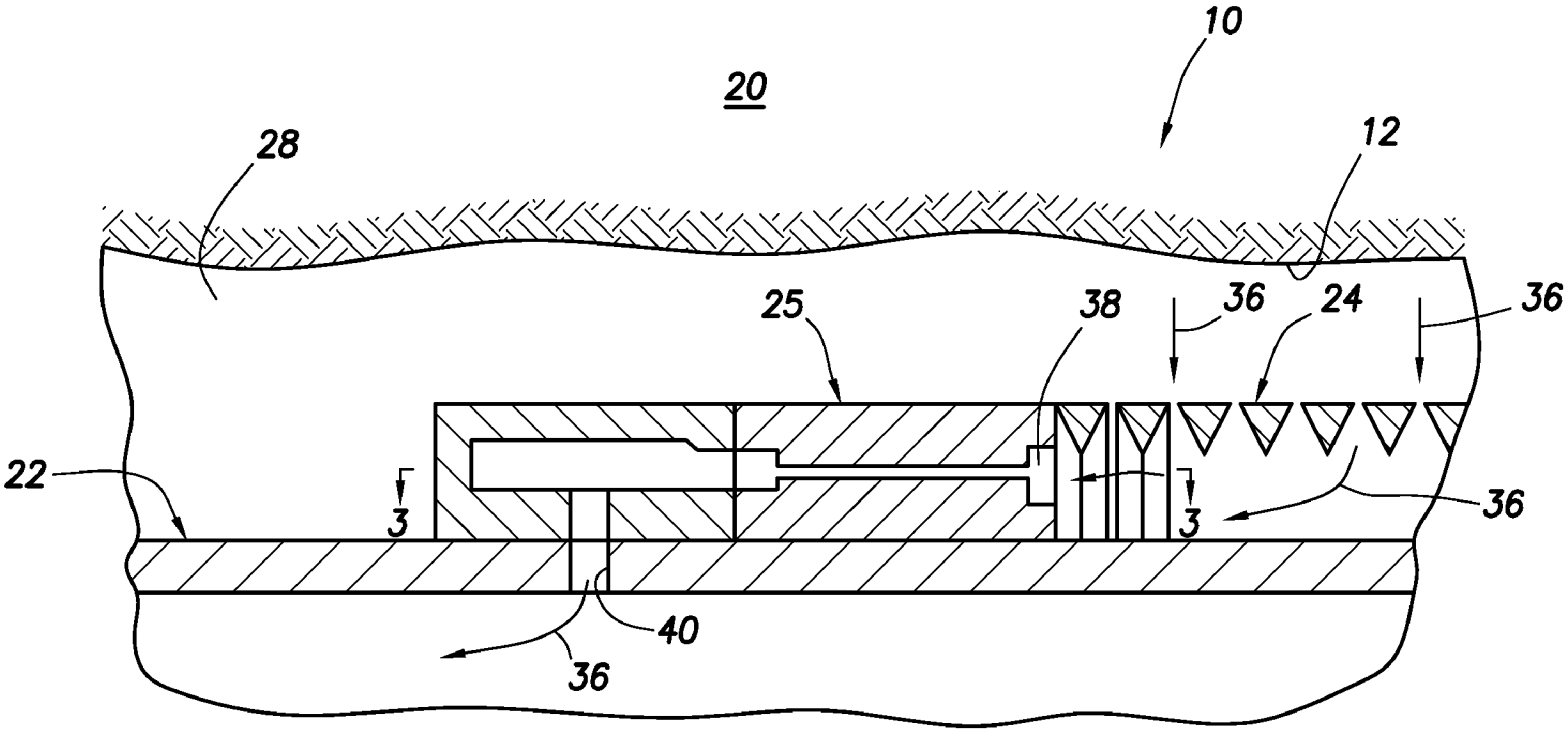
FIG. 2 is an enlarged scale schematic cross-sectional view of a well screen and a variable flow resistance system which may be used in the well system of FIG. 1.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as density, viscosity, velocity, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example, the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3:
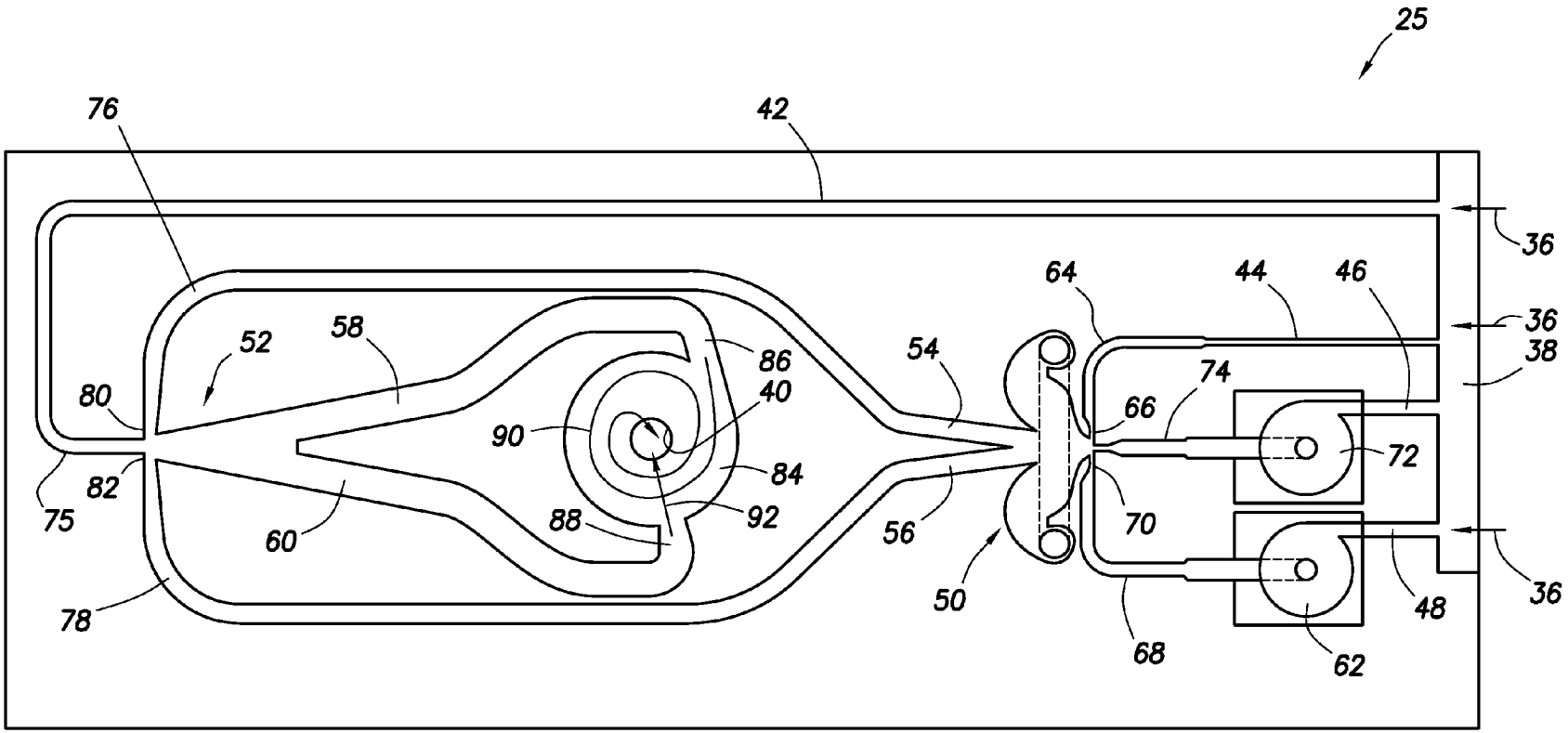
FIG. 3 is a schematic "unrolled" plan view of one configuration of the variable flow resistance system, taken along line 3-3 of FIG. 2.

Referring additionally now to FIG. 3, a more detailed cross-sectional view of one example of the system 25 is representatively illustrated. The system 25 is depicted in FIG. 3 as if it is "unrolled" from its circumferentially extending configuration to a generally planar configuration.

As described above, the fluid composition 36 enters the system 25 via the inlet 38, and exits the system via the outlet 40. A resistance to flow of the fluid composition 36 through the system 25 varies based on one or more characteristics of the fluid composition. The system 25 depicted in FIG. 3 is similar in most respects to that illustrated in FIG. 23 of the prior application Ser. No. 12/700,685 incorporated herein by reference above.

In the example of FIG. 3, the fluid composition 36 initially flows into multiple flow passages 42, 44, 46, 48. The flow passages 42, 44, 46, 48 direct the fluid composition 36 to two flow path selection devices 50, 52. The device 50 selects which of two flow paths 54, 56 a majority of the flow from the passages 44, 46, 48 will enter, and the other device 52 selects which of two flow paths 58, 60 a majority of the flow from the passages 42, 44, 46, 48 will enter.

The flow passage 44 is configured to be more restrictive to flow of fluids having higher viscosity. Flow of increased viscosity fluids will be increasingly restricted through the flow passage 44.

As used herein, the term "viscosity" is used to encompass both Newtonian and non-Newtonian rheological behaviors. Related rheological properties include kinematic viscosity, yield strength, viscoplasticity, surface tension, wettability, etc. For example, a desired fluid can have a desired range of kinematic viscosity, yield strength, viscoplasticity, surface tension, wettability, etc.

The flow passage 44 may have a relatively small flow area, the flow passage may require the fluid flowing therethrough to follow a tortuous path, surface roughness or flow impeding structures may be used to provide an increased resistance to flow of higher viscosity fluid, etc. Relatively low viscosity fluid, however, can flow through the flow passage 44 with relatively low resistance to such flow.

A control passage 64 of the flow path selection device 50 receives the fluid which flows through the flow passage 44. A control port 66 at an end of the control passage 64 has a reduced flow area to thereby increase a velocity of the fluid exiting the control passage.

The flow passage 48 is configured to have a flow resistance which is relatively insensitive to viscosity of fluids flowing therethrough, but which may be increasingly resistant to flow of higher velocity or higher density fluids. Flow of increased viscosity fluids may be increasingly resisted through the flow passage 48, but not to as great an extent as flow of such fluids would be resisted through the flow passage 44.

In the example depicted in FIG. 3, fluid flowing through the flow passage 48 must flow through a "vortex" chamber 62 prior to being discharged into a control passage 68 of the flow path selection device 50. Since the chamber 62 in this example has a cylindrical shape with a central outlet, and the fluid composition 36 spirals about the chamber, increasing in velocity as it nears the outlet, driven by a pressure differential from the inlet to the outlet, the chamber is referred to as a "vortex" chamber. In other examples, one or more orifices, venturis, nozzles, etc. may be used.

The control passage 68 terminates at a control port 70. The control port 70 has a reduced flow area, in order to increase the velocity of the fluid exiting the control passage 68.

It will be appreciated that, as a viscosity of the fluid composition 36 increases, a greater proportion of the fluid composition will flow through the flow passage 48, control passage 68 and control port 70 (due to the flow passage 44 resisting flow of higher viscosity fluid more than the flow passage 48 and vortex chamber 62). Conversely, as a viscosity of the fluid composition 36 decreases, a greater proportion of the fluid composition will flow through the flow passage 44, control passage 64 and control port 66.

Fluid which flows through the flow passage 46 also flows through a vortex chamber 72, which may be similar to the vortex chamber 62 (although the vortex chamber 72 in a preferred example provides less resistance to flow therethrough than the vortex chamber 62), and is discharged into a central passage 74. The vortex chamber 72 is used for "resistance matching" to achieve a desired balance of flows through the flow passages 44, 46, 48.

Note that dimensions and other characteristics of the various components of the system 25 will need to be selected appropriately, so that desired outcomes are achieved. In the example of FIG. 3, one desired outcome of the flow path selection device 50 is that flow of a majority of the fluid composition 36 which flows through the flow passages 44, 46, 48 is directed into the flow path 54 when the fluid composition has a sufficiently high ratio of desired fluid to undesired fluid therein.

In this example, the desired fluid is oil, which has a higher viscosity than water or gas, and so when a sufficiently high proportion of the fluid composition 36 is oil, a majority (or at least a greater proportion) of the fluid composition 36 which enters the flow path selection device 50 will be directed to flow into the flow path 54, instead of into the flow path 56. This result is achieved due to the fluid exiting the control port 70 at a greater rate, higher velocity and/or greater momentum than fluid exiting the other control port 66, thereby influencing the fluid flowing from the passages 64, 68, 74 to flow more toward the flow path 54.

If the viscosity of the fluid composition 36 is not sufficiently high (and thus a ratio of desired fluid to undesired fluid is below a selected level), a majority (or at least a greater proportion) of the fluid composition which enters the flow path selection device 50 will be directed to flow into the flow path 56, instead of into the flow path 54. This will be due to the fluid exiting the control port 66 at a greater rate, higher velocity and/or greater momentum than fluid exiting the other control port 70, thereby influencing the fluid flowing from the passages 64, 68, 74 to flow more toward the flow path 56.

It will be appreciated that, by appropriately configuring the flow passages 44, 46, 48, control passages 64, 68, control ports 66, 70, vortex chambers 62, 72, etc., the ratio of desired to undesired fluid in the fluid composition 36 at which the device 50 selects either the flow passage 54 or 56 for flow of a majority of fluid from the device can be set to various different levels.

The flow paths 54, 56 direct fluid to respective control passages 76, 78 of the other flow path selection device 52. The control passages 76, 78 terminate at respective control ports 80, 82. A central passage 75 receives fluid from the flow passage 42.

The flow path selection device 52 operates similar to the flow path selection device 50, in that a majority of fluid which flows into the device 52 via the passages 75, 76, 78 is directed toward one of the flow paths 58, 60, and the flow path selection depends on a ratio of fluid discharged from the control ports 80, 82. If fluid flows through the control port 80 at a greater rate, velocity and/or momentum as compared to fluid flowing through the control port 82, then a majority (or at least a greater proportion) of the fluid composition 36 will be directed to flow through the flow path 60. If fluid flows through the control port 82 at a greater rate, velocity and/or momentum as compared to fluid flowing through the control port 80, then a majority (or at least a greater proportion) of the fluid composition 36 will be directed to flow through the flow path 58.

Although two of the flow path selection devices 50, 52 are depicted in the example of the system 25 in FIG. 3, it will be appreciated that any number (including one) of flow path selection devices may be used in keeping with the principles of this disclosure. The devices 50, 52 illustrated in FIG. 3 are of the type known to those skilled in the art as jet-type fluid ratio amplifiers, but other types of flow path selection devices (e.g., pressure-type fluid ratio amplifiers, bi-stable fluid switches, proportional fluid ratio amplifiers, etc.) may be used in keeping with the principles of this disclosure.

Fluid which flows through the flow path 58 enters a flow chamber 84 via an inlet 86 which directs the fluid to enter the chamber generally tangentially (e.g., the chamber 84 is shaped similar to a cylinder, and the inlet 86 is aligned with a tangent to a circumference of the cylinder). As a result, the fluid will spiral about the chamber 84, until it eventually exits via the outlet 40, as indicated schematically by arrow 90 in FIG. 3.

Fluid which flows through the flow path 60 enters the flow chamber 84 via an inlet 88 which directs the fluid to flow more directly toward the outlet 40 (e.g., in a radial direction, as indicated schematically by arrow 92 in FIG. 3). As will be readily appreciated, much less energy is consumed at the same flow rate when the fluid flows more directly toward the outlet 40 as compared to when the fluid flows less directly toward the outlet.

Thus, less resistance to flow is experienced when the fluid composition 36 flows more directly toward the outlet 40 and, conversely, more resistance to flow is experienced when the fluid composition flows less directly toward the outlet. Accordingly, working upstream from the outlet 40, less resistance to flow is experienced when a majority of the fluid composition 36 flows into the chamber 84 from the inlet 88, and through the flow path 60.

A majority of the fluid composition 36 flows through the flow path 60 when fluid exits the control port 80 at a greater rate, velocity and/or momentum as compared to fluid exiting the control port 82. More fluid exits the control port 80 when a majority of the fluid flowing from the passages 64, 68, 74 flows through the flow path 54.

A majority of the fluid flowing from the passages 64, 68, 74 flows through the flow path 54 when fluid exits the control port 70 at a greater rate, velocity and/or momentum as compared to fluid exiting the control port 66. More fluid exits the control port 70 when a viscosity of the fluid composition 36 is above a selected level.

Thus, flow through the system 25 is resisted less when the fluid composition 36 has an increased viscosity (and a greater ratio of desired to undesired fluid therein). Flow through the system 25 is resisted more when the fluid composition 36 has a decreased viscosity.

More resistance to flow is experienced when the fluid composition 36 flows less directly toward the outlet 40 (e.g., as indicated by arrow 90). Thus, more resistance to flow is experienced when a majority of the fluid composition 36 flows into the chamber 84 from the inlet 86, and through the flow path 58.

A majority of the fluid composition 36 flows through the flow path 58 when fluid exits the control port 82 at a greater rate, velocity and/or momentum as compared to fluid exiting the control port 80. More fluid exits the control port 82 when a majority of the fluid flowing from the passages 64, 68, 74 flows through the flow path 56, instead of through the flow path 54.

A majority of the fluid flowing from the passages 64, 68, 74 flows through the flow path 56 when fluid exits the control port 66 at a greater rate, velocity and/or momentum as compared to fluid exiting the control port 70. More fluid exits the control port 66 when a viscosity of the fluid composition 36 is below a selected level.

As described above, the system 25 is configured to provide less resistance to flow when the fluid composition 36 has an increased viscosity, and more resistance to flow when the fluid composition has a decreased viscosity. This is beneficial when it is desired to flow more of a higher viscosity fluid, and less of a lower viscosity fluid (e.g., in order to produce more oil and less water or gas).

If it is desired to flow more of a lower viscosity fluid, and less of a higher viscosity fluid (e.g., in order to produce more gas and less water, or to inject more steam and less water), then the system 25 may be readily reconfigured for this purpose. For example, the inlets 86, 88 could conveniently be reversed, so that fluid which flows through the flow path 58 is directed to the inlet 88, and fluid which flows through the flow path 60 is directed to the inlet 86.

Figure 4:
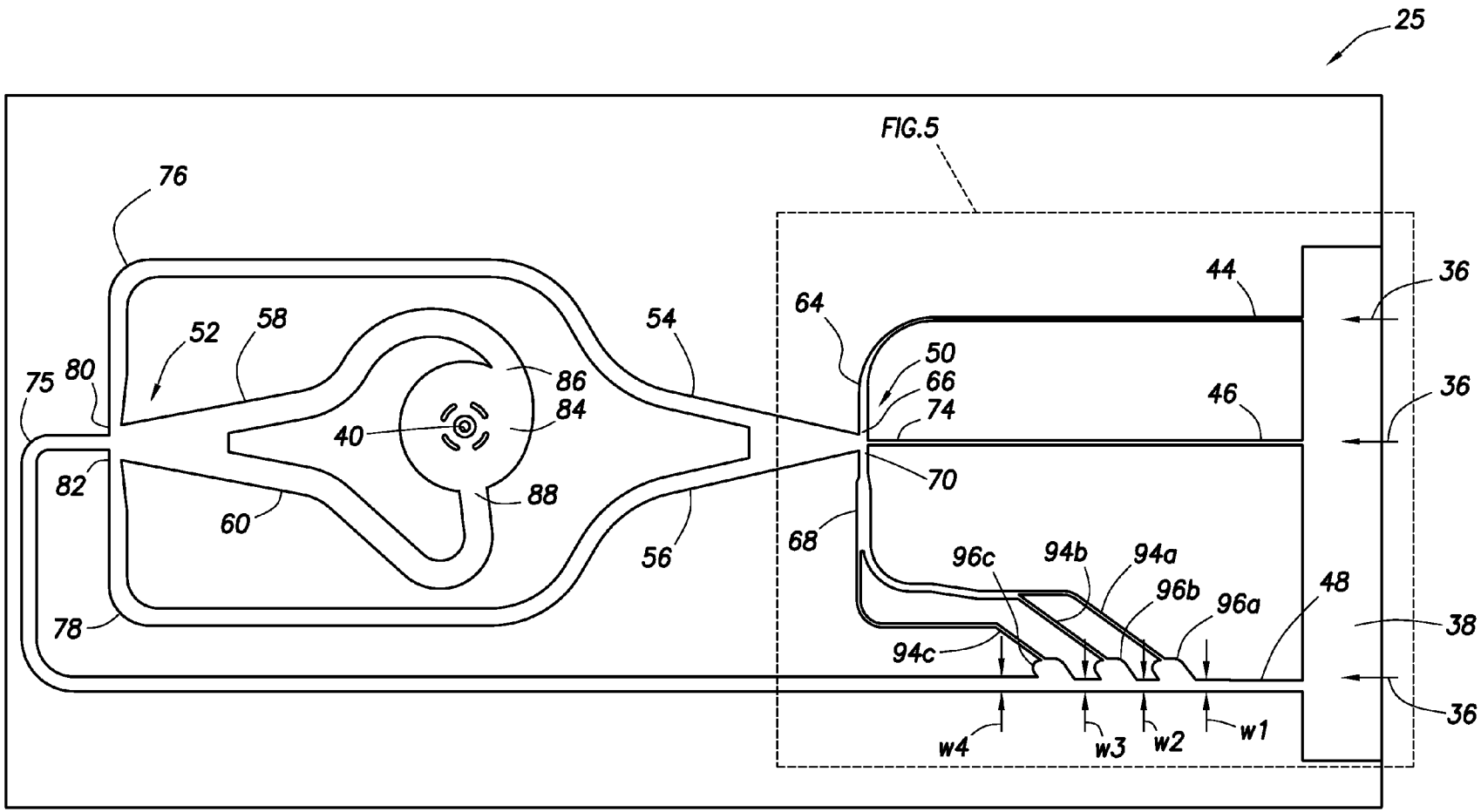
FIG. 4 is a schematic plan view of another configuration of the variable flow resistance system.

Referring additionally now to FIG. 4, another configuration of the variable flow resistance system 25 is representatively illustrated. The configuration of FIG. 4 is similar in some respects to the configuration of FIG. 3, but differs somewhat, in that the vortex chambers 62, 72 are not used for the flow passages 46, 48, and the separate flow passage 42 connecting the inlet 38 to the flow path selection device 52 is not used in the configuration of FIG. 4. Instead, the flow passage 48 connects the inlet 38 to the central passage 75 of the device 52.

A series of spaced apart branch passages 94*a-c* intersect the flow passage 48 and provide fluid communication between the flow passage and the control passage 68. Chambers 96*a-c* are provided at the respective intersections between the branch passages 94*a-c* and the flow passage 48.

A greater proportion of the fluid composition 36 which flows through the flow passage 48 will be diverted into the branch passages 94*a-c* as the viscosity of the fluid composition increases, or as the velocity of the fluid composition decreases. Thus, fluid will flow at a greater rate, velocity and/or momentum through the control port 70 of the device 50 (compared to the rate, velocity and/or momentum of fluid flow through the control port 66) as the viscosity of the fluid composition increases, or as the velocity of the fluid composition in the flow passage 48 decreases.

Preferably, the system 25 of FIG. 4 is appropriately configured so that the ratio of flows through the control ports 66, 70 has a linear or monotonic relationship to a proportion of a desired fluid in the fluid composition 36. For example, if the desired fluid is oil, then the ratio of flow through the control port 70 to flow through the control port 66 can vary with the percentage of oil in the fluid composition 36.

The chambers 96*a-c* are not strictly necessary, but are provided to enhance the effect of viscosity on the diversion of fluid into the branch passages 94*a-c*. The chambers 96*a-c* can be considered "eddy" chambers, since they provide a volume in which the fluid composition 36 can act upon itself, thereby increasing diversion of the fluid as its viscosity increases. Various different shapes, volumes, surface treatments, surface topographies, etc. may be used for the chambers 96*a-c* to further enhance the effect of viscosity on diversion of fluid into the branch passages 94*a-c*.

Although three of the branch passages 94*a-c* are depicted in FIG. 4, any number (including one) of the branch passages may be used in keeping with the principles of this disclosure. The branch passages 94*a-c* are linearly spaced apart on one side of the flow passage 48 as depicted in FIG. 4, but in other examples they could be radially, helically or otherwise spaced apart, and they could be on any side(s) of the flow passage 48, in keeping with the principles of this disclosure.

Figure 5:
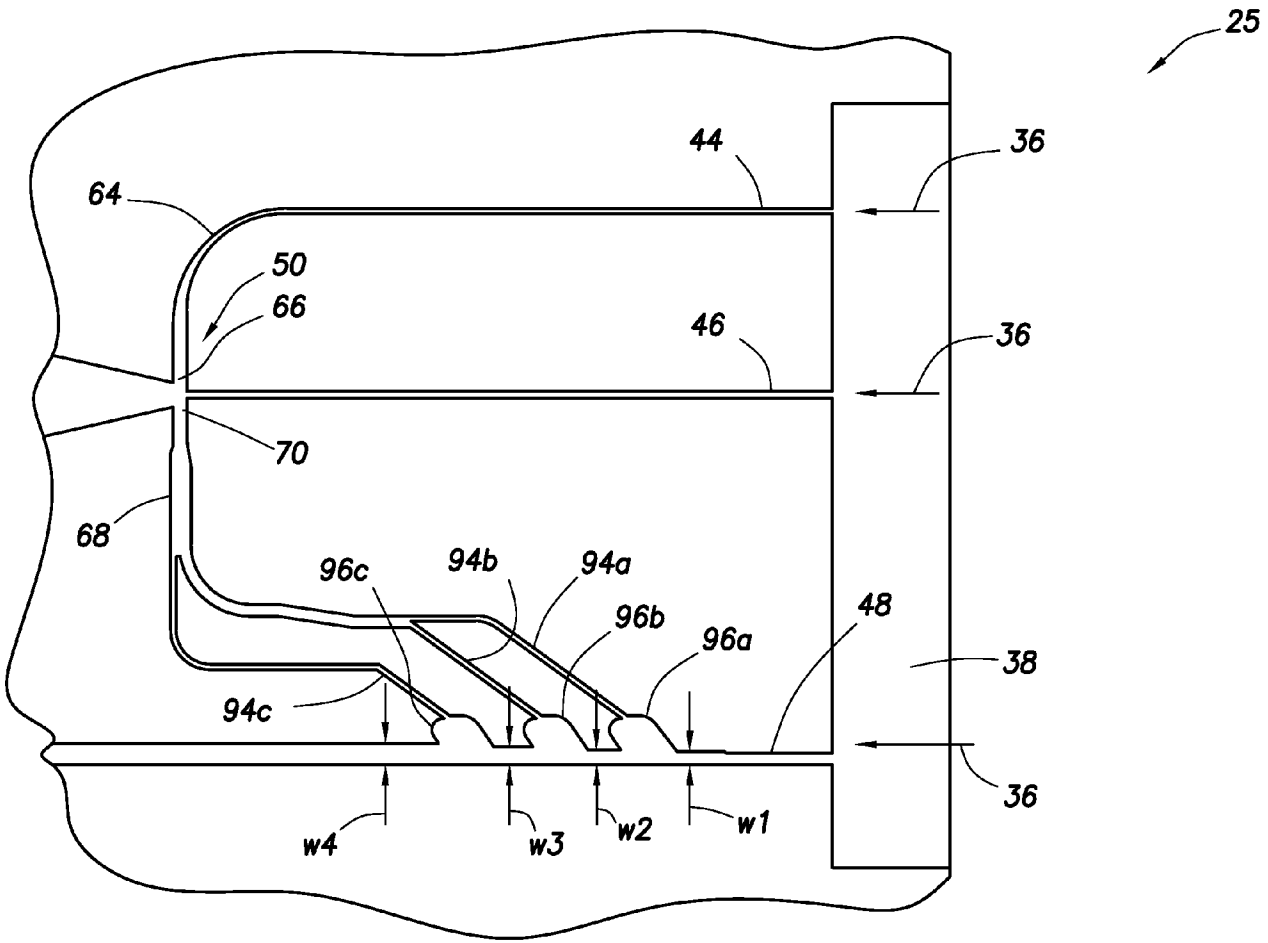
FIG. 5 is an enlarged scale schematic plan view of a portion of the variable flow resistance system of FIG. 4.

As is more clearly viewed in FIG. 5, the flow passage 48 preferably increases in width (and, thus, flow area) at each of the intersections between the branch passages 94*a-c* and the flow passage. Thus, a width w2 of the flow passage 48 is greater than a width w1 of the flow passage, width w3 is greater than width w2, and width w4 is greater than width w3. Each increase in width is preferably on the side of the flow passage 48 intersected by the respective one of the branch passages 94*a-c*.

The width of the flow passage 48 increases at each intersection with the branch passages 94*a-c*, in order to compensate for spreading of the flow of the fluid composition 36 through the flow passage. Preferably a jet-type flow of the fluid composition 36 is maintained as it traverses each of the intersections. In this manner, higher velocity and lower viscosity fluids are less influenced to be diverted into the branch passages 94*a-c*.

The intersections of the branch passages 94*a-c* with the flow passage 48 may be evenly spaced apart (as depicted in FIGS. 4 & 5) or unevenly spaced apart. The spacing of the branch passages 94*a-c* is preferably selected to maintain the jet-type flow of the fluid composition 36 through the flow passage 48 as it traverses each intersection, as mentioned above.

In the configuration of FIGS. 4 & 5, the desired fluid has a higher viscosity as compared to the undesired fluid, and so the various elements of the system 25 (e.g., flow passages 44, 48, control passages 64, 68, control ports 66, 70, branch passages 94*a-c*, chambers 96*a-c*, etc.) are appropriately configured so that the device 50 directs a majority (or at least a greater proportion) of the fluid flowing through the passages 44, 46, 48 into the flow path 54 when the fluid composition 36 has a sufficiently high viscosity. If the viscosity of the fluid composition 36 is not sufficiently high, then the device 50 directs a majority (or at least a greater proportion) of the fluid into the flow path 56.

If a majority of the fluid has been directed into the flow path 54 (i.e., if the fluid composition 36 has a sufficiently high viscosity), then the device 52 will direct a majority of the fluid composition to flow into the flow path 60. Thus, a substantial majority of the fluid composition 36 will flow into the chamber 84 via the inlet 88, and will follow a relatively direct, less resistant path to the outlet 40.

If a majority of the fluid has been directed by the device 50 into the flow path 56 (i.e., if the fluid composition 36 has a relatively low viscosity), then the device 52 will direct a majority of the fluid composition to flow into the flow path 58. Thus, a substantial majority of the fluid composition 36 will flow into the chamber 84 via the inlet 86, and will follow a relatively circuitous, more resistant path to the outlet 40.

It will, therefore, be appreciated that the system 25 of FIGS. 4 & 5 increases resistance to flow of relatively low viscosity fluid compositions, and decreases resistance to flow of relatively high viscosity fluid compositions. The level of viscosity at which resistance to flow through the system 25 increases or decreases above or below certain levels can be determined by appropriately configuring the various elements of the system.

Similarly, if the fluid flowing through the flow passage 48 has a relatively low velocity, proportionately more of the fluid will be diverted from the flow passage and into the branch passages 94*a-c*, resulting in a greater ratio of fluid flow through the control port 70 to fluid flow through the control port 66. As a result, a majority (or at least a greater proportion) of the fluid composition will flow through the inlet 88 into the chamber 84, and the fluid composition will follow a relatively direct, less resistant path to the outlet 40.

Conversely, if the fluid flowing through the flow passage 48 has a relatively high velocity, proportionately less of the fluid will be diverted from the flow passage and into the branch passages 94*a-c*, resulting in a decreased ratio of fluid flow through the control port 70 to fluid flow through the control port 66. As a result, a majority (or at least a greater proportion) of the fluid composition 36 will flow through the inlet 86 into the chamber 84, and the fluid composition will follow a relatively circuitous, more resistant path to the outlet 40.

It will, therefore, be appreciated that the system 25 of FIGS. 4 & 5 increases resistance to flow of relatively high velocity fluid compositions, and decreases resistance to flow of relatively low velocity fluid compositions. The level of velocity at which resistance to flow through the system 25 increases or decreases above or below a certain level can be determined by appropriately configuring the various elements of the system.

In one preferred example of the system 25, the flow of a relatively low viscosity fluid (such as the fluid composition 36 having a high proportion of gas therein) is resisted by the system, no matter its velocity (above a minimum threshold velocity). However, the flow of a relatively high viscosity fluid (such as the fluid composition 36 having a high proportion of oil therein) is resisted by the system only when its velocity is above a selected level. Again, these characteristics of the system 25 can be determined by appropriately configuring the various elements of the system.

Figure 6:
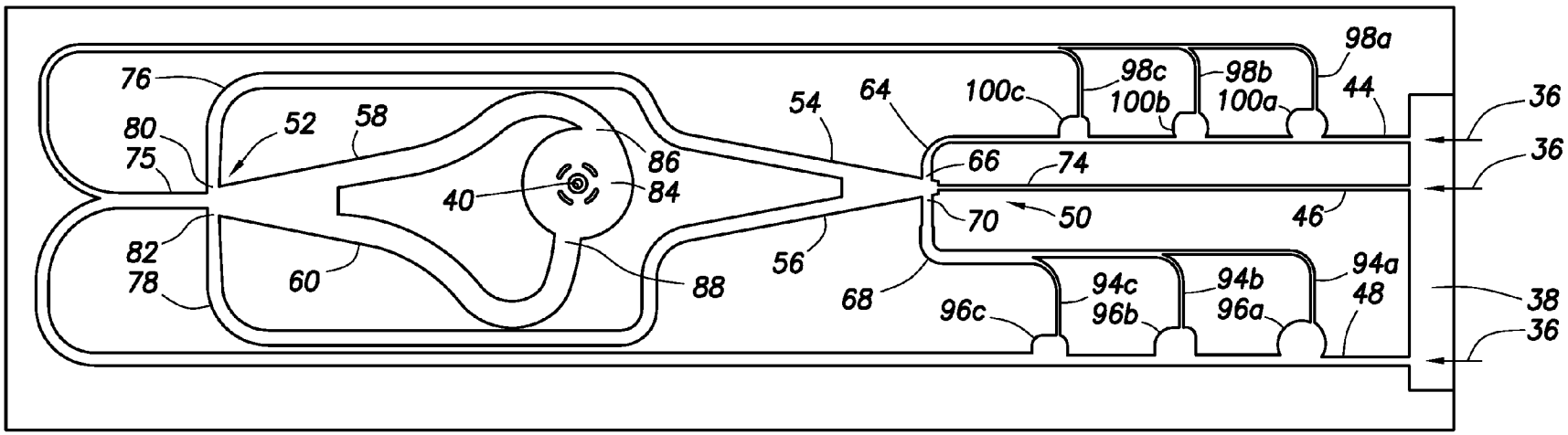
FIG. 6 is a schematic plan view of yet another configuration of the variable flow resistance system.

Referring additionally now to FIG. 6, another configuration of the system 25 is representatively illustrated. The configuration of FIG. 6 is similar in many respects to the configuration of FIGS. 4 & 5, but differs somewhat, in that fluid from both of the flow passages 44, 48 is communicated to the central passage 75 of the device 52, and a spaced apart series of branch passages 98*a-c* intersect the flow passage 44, with chambers 100*a-c* at the intersections. Any number (including one), spacing, size, configuration, etc., of the branch passages 98*a-c* and chambers 100*a-c* may be used in keeping with the principles of this disclosure.

Similar to the branch passages 94*a-c* and chambers 96*a-c* described above, the branch passages 98*a-c* and chambers 100*a-c* operate to divert proportionately more fluid from the flow passage 44 (and to the central passage 75 of the device 52) as the viscosity of the fluid composition 36 increases, or as the velocity of the fluid composition decreases in the flow passage. Thus, proportionately less fluid is delivered to the control port 66 as the viscosity of the fluid composition 36 increases, or as the velocity of the fluid composition decreases in the flow passage 44.

Since more fluid is delivered to the control port 70 as the viscosity of the fluid composition 36 increases, or as the velocity of the fluid composition decreases in the flow passage 48 (as described above in relation to the configuration of FIGS. 4 & 5), the ratio of fluid flow through the control port 70 to fluid flow through the control port 66 increases substantially more when the viscosity of the fluid composition 36 increases, or when the velocity of the fluid composition decreases in the configuration of FIG. 6, as compared to the configuration of FIGS. 4 & 5.

Conversely, the ratio of fluid flow through the control port 70 to fluid flow through the control port 66 decreases substantially more when the viscosity of the fluid composition 36 decreases, or when the velocity of the fluid composition increases in the configuration of FIG. 6, as compared to the configuration of FIGS. 4 & 5. Thus, the system 25 of FIG. 6 is more responsive to changes in viscosity or velocity of the fluid composition 36, as compared to the system of FIGS. 4 & 5.

Another difference in the configuration of FIG. 6 is that the chambers 96*a-c* and the chambers 100*a-c* decrease in volume stepwise in a downstream direction along the respective flow passages 48, 44. Thus, the chamber 96*b* has a smaller volume than the chamber 96*a*, and the chamber 96*c* has a smaller volume than the chamber 96*b*. Similarly, the chamber 100*b* has a smaller volume than the chamber 100*a*, and the chamber 100*c* has a smaller volume than the chamber 100*b*.

The changes in volume of the chambers 96*a-c* and 100*a-c* can help to compensate for changes in flow rate, velocity, etc. of the fluid composition 36 through the respective passages 48, 44. For example, at each successive intersection between the branch passages 94*a-c* and the flow passage 48, the velocity of the fluid through the flow passage 48 will decrease, and the volume of the respective one of the chambers 96*a-c* decreases accordingly. Similarly, at each successive intersection between the branch passages 98*a-c* and the flow passage 44, the velocity of the fluid through the flow passage 44 will decrease, and the volume of the respective one of the chambers 100*a-c* decreases accordingly.

One advantage of the configurations of FIGS. 4-6 over the configuration of FIG. 3 is that all of the flow passages, flow paths, control passages, branch passages, etc. in the configurations of FIGS. 4-6 are preferably in a single plane (as viewed in the drawings). Of course, when the system 25 extends circumferentially about, or in, a tubular structure, the passages, flow paths, etc. would preferably be at a same radial distance in or on the tubular structure. This makes the system 25 less difficult and expensive to construct.

Figure 7A:
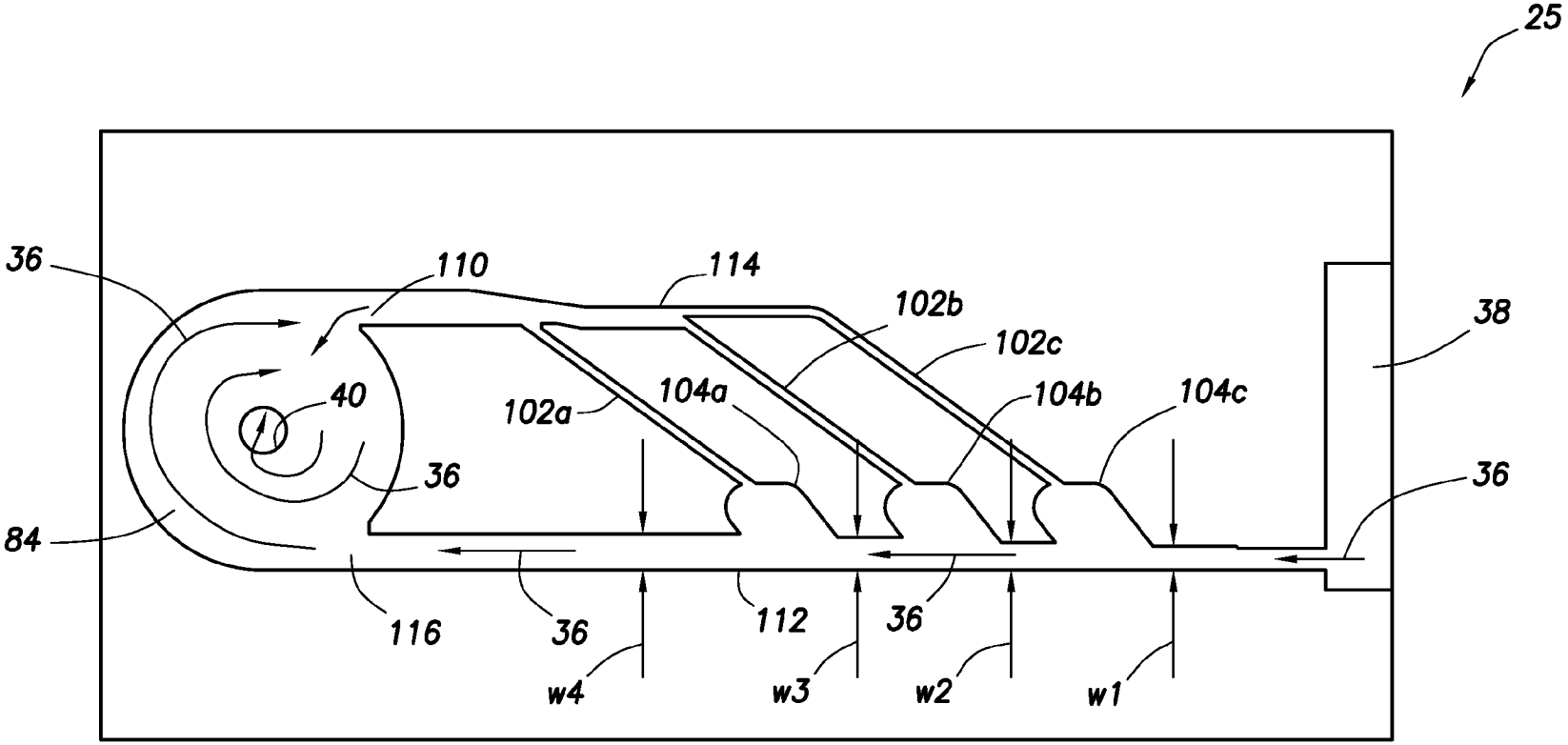
FIGS. 7A & B are schematic plan views of a further configuration of the variable flow resistance system.

Referring additionally now to FIGS. 7A & B, another configuration of the variable flow resistance system 25 is representatively illustrated. The system 25 of FIGS. 7A & B is much less complex as compared to the systems of FIGS. 3-5, at least in part because it does not include the flow path selection devices 50, 52.

The flow chamber 84 of FIGS. 7A & B is also somewhat different, in that two inlets 116, 110 to the chamber are supplied with flow of the fluid composition 36 via two flow passages 110, 112 which direct the fluid composition to flow in opposing directions about the outlet 40. As depicted in FIGS. 7A & B, fluid which enters the chamber 84 via the inlet 116 is directed to flow in a clockwise direction about the outlet 40, and fluid which enters the chamber via the inlet 110 is directed to flow in a counter-clockwise direction about the outlet.

In FIG. 7A, the system 25 is depicted in a situation in which an increased velocity and/or reduced viscosity of the fluid composition 36 results in a majority of the fluid composition flowing into the chamber 84 via the inlet 116. The fluid composition 36, thus spirals about the outlet 40 in the chamber 84, and a resistance to flow through the system 25 increases. The reduced viscosity could result from a relatively low ratio of desired fluid to undesired fluid in the fluid composition 36.

Relatively little of the fluid composition 36 flows into the chamber 84 via the inlet 110 in FIG. 7A, because the flow passage 114 is connected to branch passages 102*a-c* which branch from the flow passage 112 at eddy chambers 104*a-c*. At relatively high velocities and/or low viscosities, the fluid composition 36 tends to flow past the eddy chambers 104*a-c*, without a substantial amount of the fluid composition flowing through the eddy chambers and branch passages 102*a-c* to the flow passage 114.

Figure 7B:
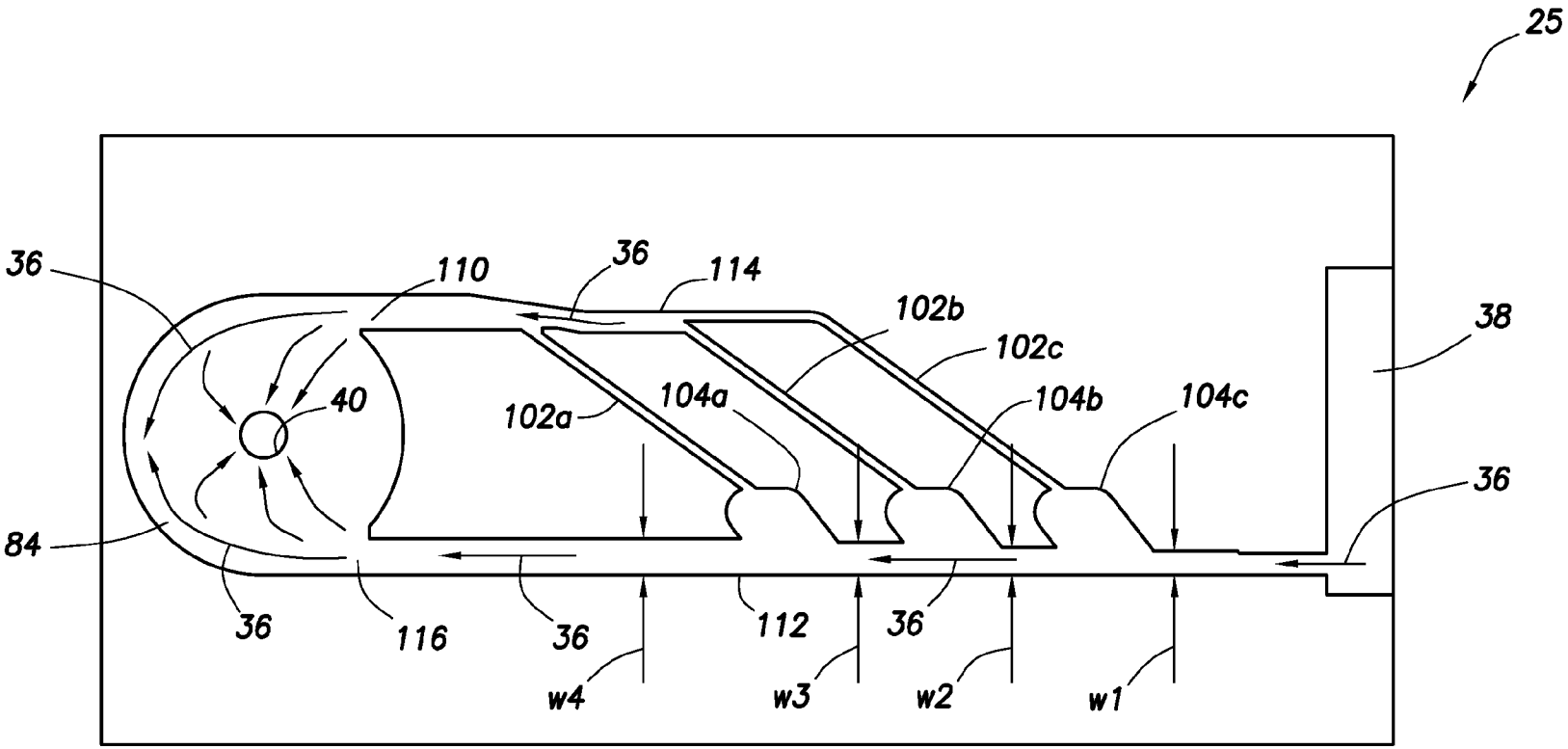

In FIG. 7B, a velocity of the fluid composition 36 has decreased and/or a viscosity of the fluid composition has increased, and as a result, proportionately more of the fluid composition flows from the passage 112 into the branch passages 102*a-c* and via the passage 114 to the inlet 110. Since the flows into the chamber 84 from the two inlets 116, 110 are in opposing directions, they counteract each other, resulting in a disruption of the vortex 90 in the chamber.

As depicted in FIG. 7B, the fluid composition 36 flows less spirally about the outlet 40, and more directly to the outlet, thereby reducing the resistance to flow through the system 25. Thus, resistance to flow through the system 25 is decreased when the velocity of the fluid composition 36 decreases, when the viscosity of the fluid composition increases, or when a ratio of desired fluid to undesired fluid in the fluid composition increases.

Figure 8A:
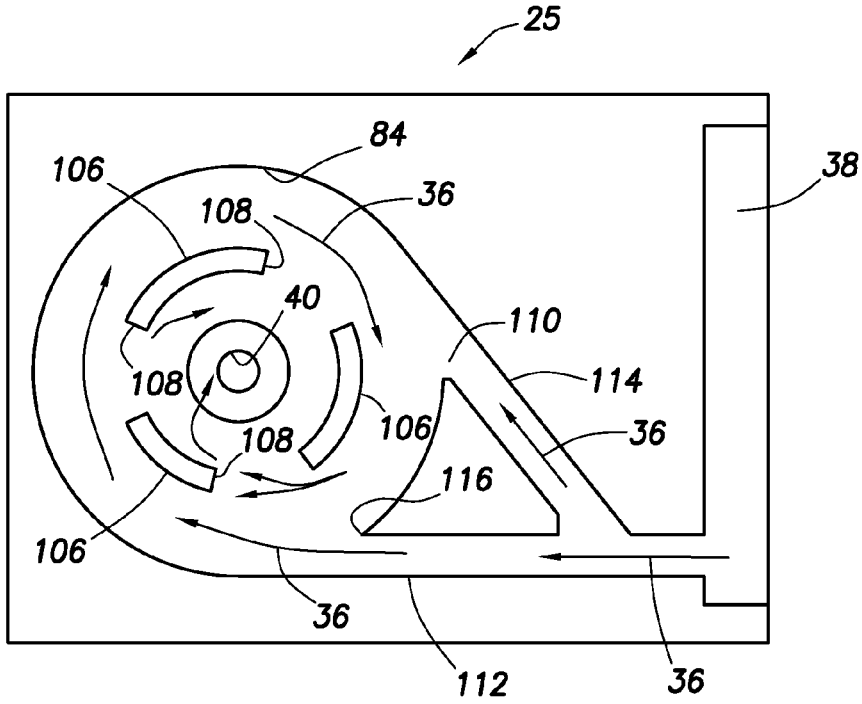
FIGS. 8A & B are schematic plan views of another configuration of the variable flow resistance system.

Referring additionally now to FIGS. 8A & B, another configuration of the variable flow resistance system 25 is representatively illustrated. The system 25 of FIGS. 8A & B is similar in many respects to the system of FIGS. 7A & B, but differs at least in that the branch passages 102*a-c* and eddy chambers 104*a-c* are not necessarily used in the FIGS. 8A & B configuration. Instead, the flow passage 114 itself branches off of the flow passage 112.

Another difference is that circular flow inducing structures 106 are used in the chamber 84 in the configuration of FIGS. 8A & B. The structures 106 operate to maintain circular flow of the fluid composition 36 about the outlet 40, or at least to impede inward flow of the fluid composition toward the outlet, when the fluid composition does flow circularly about the outlet. Openings 108 in the structures 106 permit the fluid composition 36 to eventually flow inward to the outlet 40.

The structures 106 are an example of how the configuration of the system 25 can be altered to produce a desired flow resistance (e.g., when the fluid composition 36 has a predetermined viscosity, velocity, density, ratio of desired to undesired fluid therein, etc.). The manner in which the flow passage 114 is branched off of the flow passage 112 is yet another example of how the configuration of the system 25 can be altered to produce a desired flow resistance.

In FIG. 8A, the system 25 is depicted in a situation in which an increased velocity and/or reduced viscosity of the fluid composition 36 results in a majority of the fluid composition flowing into the chamber 84 via the inlet 116. The fluid composition 36, thus, spirals about the outlet 40 in the chamber 84, and a resistance to flow through the system 25 increases. The reduced viscosity can be due to a relatively low ratio of desired fluid to undesired fluid in the fluid composition 36.

Relatively little of the fluid composition 36 flows into the chamber 84 via the inlet 110 in FIG. 8A, because the flow passage 114 is branched from the flow passage 112 in a manner such that most of the fluid composition remains in the flow passage 112. At relatively high velocities and/or low viscosities, the fluid composition 36 tends to flow past the flow passage 114.

Figure 8B:
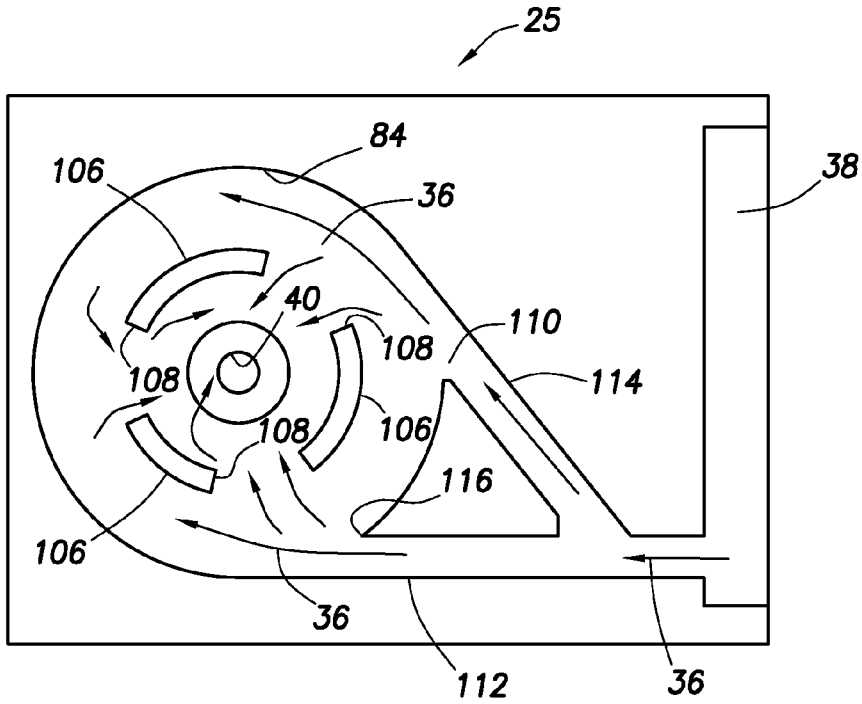

In FIG. 8B, a velocity of the fluid composition 36 has decreased and/or a viscosity of the fluid composition has increased, and as a result, proportionately more of the fluid composition flows from the passage 112 and via the passage 114 to the inlet 110. The increased viscosity of the fluid composition 36 may be due to an increased ratio of desired to undesired fluids in the fluid composition.

Since the flows into the chamber 84 from the two inlets 116, 110 are oppositely directed (or at least the flow of the fluid composition through the inlet 110 opposes the flow through the inlet 116), they counteract each other, resulting in a disruption of the vortex 90 in the chamber. Thus, the fluid composition 36 flows more directly to the outlet 40 and a resistance to flow through the system 25 is decreased.

Note that any of the features of any of the configurations of the system 25 described above may be included in any of the other configurations of the system and, thus, it should be understood that these features are not exclusive to any one particular configuration of the system. The system 25 can be used in any type of well system (e.g., not only in the well system 10), and for accomplishing various purposes in various well operations, including but not limited to injection, stimulation, completion, production, conformance, drilling operations, etc.

It may now be fully appreciated that the above disclosure provides substantial advancements to the art of controlling fluid flow in a well. Fluid flow can be variably resisted based on various characteristics (e.g., viscosity, density, velocity, etc.) of a fluid composition which flows through a variable flow resistance system.

In particular, the above disclosure provides to the art a system 25 for variably resisting flow of a fluid composition 36 in a subterranean well. The system 25 can include a first flow passage 48, 112 and a first set of one or more branch passages 94*a-c*, 100, 102*a-c* which intersect the first flow passage 48, 112. In this manner, a proportion of the fluid composition 36 diverted from the first flow passage 48, 112 to the first set of branch passages 94*a-c*, 100, 102*a-c* varies based on at least one of a) viscosity of the fluid composition 36, and b) velocity of the fluid composition 36 in the first flow passage 48, 98.

The proportion of the fluid composition 36 diverted from the first flow passage 48, 112 to the first set of branch passages 94*a-c*, 100, 102*a-c* preferably increases in response to increased viscosity of the fluid composition 36.

The proportion of the fluid composition 36 diverted from the first flow passage 48, 112 to the first set of branch passages 94*a-c*, 100, 102*a-c* preferably increases in response to decreased velocity of the fluid composition 36 in the first flow passage 48, 112.

The first set of branch passages 94*a-c* can direct the fluid composition 36 to a first control passage 68 of a flow path selection device 50. The flow path selection device 50 can select which of multiple flow paths 54, 56 a majority of fluid flows through from the device 50, based at least partially on the proportion of the fluid composition 36 diverted to the first control passage 68.

The system 25 can include a second flow passage 44 with a second set of one or more branch passages 98*a-c* which intersect the second flow passage 44. In this configuration, a proportion of the fluid composition 36 diverted from the second flow passage 44 to the second set of branch passages 98*a-c* preferably increases with increased viscosity of the fluid composition 36, and increases with decreased velocity of the fluid composition 36 in the second flow passage 44.

The second flow passage 44 can direct the fluid composition 36 to a second control passage 64 of the flow path selection device 50. The flow path selection device 50 can select which of the multiple flow paths 54, 56 the majority of fluid flows through from the device 50, based on a ratio of flow rates of the fluid composition 36 through the first and second control passages 64, 68. The ratio of the flow rates through the first and second control passages 64, 68 preferably varies with respect to a ratio of desired fluid to undesired fluid in the fluid composition 36.

The first set of branch passages 94*a-c*, 100, 102*a-c* can include multiple branch passages spaced apart along the first flow passage 48, 112. A chamber 96*a-c*, 104*a-c* may be provided at each of multiple intersections between the first flow passage 48, 112 and the branch passages 94*a-c*, 102*a-c*.

Each of the chambers 96*a-c*, 104*a-c* has a fluid volume, and the volumes may decrease in a direction of flow of the fluid composition 36 through the first flow passage 48, 112. A flow area of the first flow passage 48, 112 may increase at each of multiple intersections between the first flow passage 48, 112 and the first set of branch passages 94*a-c*, 102*a-c*.

Also described above is a system 25 for variably resisting flow of a fluid composition 36 in a subterranean well, with the system 25 including a flow path selection device 50 that selects which of multiple flow paths 54, 56 a majority of fluid flows through from the device, based on a ratio of desired fluid to undesired fluid in the fluid composition 36.

The flow path selection device 50 can include a first control port 70. A flow rate of the fluid composition 36 through the first control port 70 affects which of the multiple flow paths the majority of fluid flows through from the device 50. The flow rate of the fluid composition 36 through the first control port 70 preferably varies based on the ratio of desired fluid to undesired fluid in the fluid composition 36.

The flow path selection device 50 can also include a second control port 66. The flow path selection device 50 can select which of multiple flow paths 54, 56 the majority of fluid flows through from the device 50, based on a ratio of a) the flow rate of the fluid composition 36 through the first control port 70 to b) a flow rate of the fluid composition 36 through the second control port 66. The ratio of the flow rates through the first and second control ports 70, 66 preferably varies with respect to the ratio of desired fluid to undesired fluid in the fluid composition 36.

The fluid composition 36 can flow to the first control port 70 via at least one control passage 68 which connects to a flow passage 48 through which the fluid composition 36 flows. A flow rate of the fluid composition 36 from the flow passage 48 to the control passage 68 can vary based on the ratio of desired fluid to undesired fluid in the fluid composition 36. A proportion of the fluid composition 36 which flows from the flow passage 48 to the control passage 68 can increase when a viscosity of the fluid composition 36 increases, and/or decrease when a velocity of the fluid composition 36 in the flow passage 48 increases.

The flow path selection device 50 can include a second control port 66. A flow rate of the fluid composition 36 through the second control port 66 affects which of the multiple flow paths 54, 56 the majority of fluid flows through from the device 50.

The fluid composition 36 flows to the second control port 66 via at least one control passage 64 through which the fluid composition 36 flows. The control passage 64 connects to at least one flow passage 44, and a flow rate of the fluid composition 36 from the flow passage 44 to the control passage 64 can vary based on the ratio of desired fluid to undesired fluid in the fluid composition 36.

A proportion of the fluid composition 36 which flows from the flow passage 44 to the control passage 64 can decrease when a viscosity of the fluid composition 36 increases, and/or increase when a velocity of the fluid composition 36 in the flow passage 44 increases.

The above disclosure also provides to the art a system 25 for variably resisting flow of a fluid composition 36 in a subterranean well, with the system 25 including a flow chamber 84. A majority of the fluid composition 36 enters the chamber 84 in a direction which changes based on a ratio of desired fluid to undesired fluid in the fluid composition 36.

The fluid composition 36 can more directly flow through the chamber 84 to an outlet 40 of the chamber 84 in response to an increase in the ratio of desired fluid to undesired fluid in the fluid composition 36.

The majority of the fluid composition 36 enters the chamber 84 via one of multiple inlets 86, 88. The one of the multiple inlets 86, 88 which the majority of the fluid composition 36 enters is selected based on the ratio of desired fluid to undesired fluid in the fluid composition 36.

A first inlet 88 directs the fluid composition 36 to flow more directly toward an outlet 40 of the chamber 84 as compared to a second inlet 86. The first inlet 88 may direct the fluid composition 36 to flow more radially relative to the outlet 40 as compared to the second inlet 86. The second inlet 86 may direct the fluid composition 36 to spiral more about the outlet 40 as compared to the first inlet 88.

The chamber 84 can be generally cylindrical-shaped, and the fluid composition 36 may spiral more within the chamber 84 as the ratio of desired fluid to undesired fluid in the fluid composition 36 decreases.

The system 25 preferably includes a flow path selection device 50 that selects which of multiple flow paths 54, 56 a majority of fluid flows through from the device, based on the ratio of desired fluid to undesired fluid in the fluid composition 36.

The flow path selection device 50 includes a first control port 70. A flow rate of the fluid composition 36 through the first control port 70 affects which of the multiple flow paths 54, 56 the majority of fluid flows through from the device. The flow rate of the fluid composition 36 through the first control port 70 varies based on the ratio of desired fluid to undesired fluid in the fluid composition 36.

The flow path selection device 50 can also include a second control port 66. A ratio of a) the flow rate of the fluid composition 36 through the first control port 70 to b) a flow rate of the fluid composition 36 through the second control port 66 affects which of the multiple flow paths the majority of fluid flows through from the device. The ratio of the flow rates through the first and second control ports 70, 66 preferably varies with respect to the ratio of desired fluid to undesired fluid in the fluid composition 36.

The fluid composition 36 can flow to the first control port 70 via at least one control passage 68 which connects to a flow passage 48 through which the fluid composition 36 flows. A flow rate of the fluid composition 36 from the flow passage 48 to the control passage 68 can vary based on the ratio of desired fluid to undesired fluid in the fluid composition 36.

The flow path selection device 50 can include a second control port 66. A flow rate of the fluid composition 36 through the second control port 66 affects which of the multiple flow paths 54, 56 the majority of fluid flows through from the device 50. The fluid composition 36 flows to the second control port 66 via at least one control passage 64 through which the fluid composition 36 flows.

The control passage 64 connects to at least one flow passage 44. A flow rate of the fluid composition 36 from the flow passage 44 to the control passage 64 varies based on the ratio of desired fluid to undesired fluid in the fluid composition 36.

Also described above is system 25 for variably resisting flow of a fluid composition 36 in a subterranean well, with the system 25 including a flow chamber 84. A majority of the fluid composition 36 enters the chamber 84 in a direction which changes based on a velocity of the fluid composition 36.

The fluid composition 36 can more directly flow through the chamber 84 to an outlet 40 of the chamber 84 in response to a decrease in the velocity.

The majority of the fluid composition 36 can enter the chamber 84 via one of multiple inlets 86, 88. The one of the multiple inlets 86, 88 is selected based on the velocity. A first one 88 of the multiple inlets may direct the fluid composition 36 to flow more directly toward an outlet 40 of the chamber 84 as compared to a second one 86 of the multiple inlets.

The first inlet 88 may direct the fluid composition 86 to flow more radially relative to the outlet 40 as compared to the second inlet 86. The second inlet 86 may direct the fluid composition 36 to spiral more about the outlet 40 as compared to the first inlet 88.

The chamber 84 may be generally cylindrical-shaped, and the fluid composition 36 may spiral more within the chamber 84 as the velocity increases.

The system 25 can also include a flow path selection device 52 that selects which of multiple flow paths 58, 60 the majority of the fluid composition 36 flows through from the device 52, based on the velocity of the fluid composition 36.

The above disclosure also describes a variable flow resistance system 25 for use in a subterranean well, with the variable flow resistance system 25 comprising a flow chamber 84 having an outlet 40, and at least first and second inlets 116, 110. A fluid composition 36 which enters the flow chamber 84 via the second inlet 110 opposes flow of the fluid composition 36 which enters the flow chamber 84 via the first inlet 116, whereby a resistance to flow of the fluid composition 36 through the flow chamber 84 varies with a ratio of flows through the first and second inlets 116, 110.

A resistance to flow of the fluid composition 36 through the flow chamber 84 may decrease as flow through the first and second inlets 116, 110 becomes more equal. Flow through the first and second inlets 116, 110 may become more equal as a viscosity of the fluid composition 36 increases, as a velocity of the fluid composition 36 decreases, as a density of the fluid composition 36 decreases, and/or as a ratio of desired fluid to undesired fluid in the fluid composition 36 increases.

A resistance to flow of the fluid composition 36 through the flow chamber 84 may increase as flow through the first and second inlets 116, 110 becomes less equal.

The fluid composition 36 may flow to the first inlet 116 via a first flow passage 112 which is oriented generally tangential to the flow chamber 84. The fluid composition 36 may flow to the second inlet 110 via a second flow passage 114 which is oriented generally tangential to the flow chamber 84, and the second passage 114 may receive the fluid composition 36 from a branch of the first flow passage 112.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A system for variably resisting flow of a fluid composition in a subterranean well, the system comprising:

a first flow passage through which the fluid composition flows; and a first set of one or more branch passages which intersect the first flow passage, whereby a proportion of the fluid composition diverted from the first flow passage to the first set of branch passages varies based on at least one of a) viscosity of the fluid composition in the first flow passage, and b) velocity of the fluid composition in the first flow passage.

2. The system of claim 1, wherein the proportion increases in response to increased viscosity of the fluid composition.

3. The system of claim 1, wherein the proportion increases in response to decreased velocity of the fluid composition in the first flow passage.

4. The system of claim 1, wherein the first set of branch passages direct the fluid composition to a first control passage of a flow path selection device, and wherein the flow path selection device selects which of multiple flow paths a majority of fluid flows through from the device, based at least partially on the proportion of the fluid composition diverted to the first control passage.

5. The system of claim 4, further comprising a second flow passage, and a second set of one or more branch passages which intersect the second flow passage, whereby a proportion of the fluid composition diverted from the second flow passage to the second set of branch passages increases with increased viscosity of the fluid composition, and increases with decreased velocity of the fluid composition in the second flow passage.

6. The system of claim 5, wherein the second flow passage directs the fluid composition to a second control passage of the flow path selection device, and wherein the flow path selection device selects which of the multiple flow paths the majority of fluid flows through from the device, based on a ratio of flow rates of the fluid composition through the first and second control passages.

7. The system of claim 6, wherein the ratio of the flow rates through the first and second control passages varies with respect to a ratio of desired fluid to undesired fluid in the fluid composition.

8. The system of claim 4, further comprising a second flow passage, wherein the second flow passage directs the fluid composition to a second control passage of the flow path selection device, and wherein the flow path selection device selects which of the multiple flow paths the majority of fluid flows through from the device, based on a ratio of flow rates of the fluid composition through the first and second control passages.

9. The system of claim 1, wherein the first set of branch passages includes multiple branch passages spaced apart along the first flow passage.

10. The system of claim 9, further comprising a chamber at each of multiple intersections between the first flow passage and the branch passages.

11. The system of claim 10, wherein each of the chambers has a fluid volume, and wherein the volumes decrease in a direction of flow of the fluid composition through the first flow passage.

12. The system of claim 9, wherein a flow area of the first flow passage increases at each of multiple intersections between the first flow passage and the first set of branch passages.

13. A system for variably resisting flow of a fluid composition in a subterranean well, the system comprising:

a flow chamber, wherein the fluid composition includes a desired fluid and an undesired fluid, wherein a majority of the fluid composition enters the chamber in a direction which changes based on a ratio of the desired fluid to the undesired fluid in the fluid composition, wherein the majority of the fluid composition enters the chamber via one of multiple inlets, and wherein the one of the multiple inlets is selected based on the ratio.

14. The system of claim 13, wherein the fluid composition more directly flows through the chamber to an outlet of the chamber in response to an increase in the ratio.

15. The system of claim 13, wherein a first one of the multiple inlets directs the fluid composition to flow more directly toward an outlet of the chamber as compared to a second one of the multiple inlets.

16. The system of claim 15, wherein the first inlet directs the fluid composition to flow more radially relative to the outlet as compared to the second inlet.

17. The system of claim 15, wherein the second inlet directs the fluid composition to spiral more about the outlet as compared to the first inlet.

18. The system of claim 13, wherein the chamber is generally cylindrical-shaped, and wherein the fluid composition spirals more within the chamber as the ratio decreases.

19. A system for variably resisting flow of a fluid composition in a subterranean well, the system comprising:

a flow chamber, wherein a majority of the fluid composition enters the chamber in a direction which changes based on a ratio of desired fluid to undesired fluid in the fluid composition, and wherein the majority of the fluid composition enters the chamber via one of multiple inlets; and a flow path selection device that selects which of multiple flow paths the majority of the fluid composition flows through from the device, based on the ratio of desired fluid to undesired fluid in the fluid composition.

20. The system of claim 19, wherein the flow path selection device includes a first control port, and wherein a flow rate of the fluid composition through the first control port affects which of the multiple flow paths the majority of the fluid composition flows through.

21. The system of claim 20, wherein the fluid composition flows to the first control port via at least one control passage which connects to a flow passage through which the fluid composition flows, and wherein a flow rate of the fluid composition from the flow passage to the control passage varies based on the ratio of desired fluid to undesired fluid in the fluid composition.

22. The system of claim 20, wherein the flow path selection device includes a second control port, wherein a flow rate of the fluid composition through the second control port affects which of the multiple flow paths the majority of the fluid composition flows through from the device, wherein the fluid composition flows to the second control port via at least one control passage through which the fluid composition flows, wherein the control passage connects to at least one flow passage, and wherein a flow rate of the fluid composition from the flow passage to the control passage varies based on the ratio of desired fluid to undesired fluid in the fluid composition.

23. The system of claim 20, wherein the flow rate of the fluid composition through the first control port varies based on the ratio of desired fluid to undesired fluid in the fluid composition.

24. The system of claim 20, wherein the flow path selection device further includes a second control port, and wherein a ratio of the flow rates of the fluid composition through the first and second control ports affects which of the multiple flow paths the majority of fluid composition flows through from the device.

25. The system of claim 24, wherein the ratio of the flow rates through the first and second control ports varies with respect to the ratio of desired fluid to undesired fluid in the fluid composition.

26. A system for variably resisting flow of a fluid composition in a subterranean well, the system comprising:

a flow chamber, wherein a majority of the fluid composition enters the chamber from a flow passage in a direction which changes based on a velocity of the fluid composition in the flow passage, and wherein the majority of the fluid composition enters the chamber via one of multiple inlets; and a flow path selection device that selects which of multiple flow paths the majority of the fluid composition flows through from the device, based on the velocity of the fluid composition.

27. The system of claim 26, wherein the fluid composition more directly flows through the chamber to an outlet of the chamber in response to a decrease in the velocity.

28. The system of claim 26, wherein the chamber is generally cylindrical-shaped, and wherein the fluid composition spirals more within the chamber as the velocity increases.

29. A system for variably resisting flow of a fluid composition in a subterranean well, the system comprising:

a flow chamber, wherein a majority of the fluid composition enters the chamber from a flow passage in a direction which changes based on a velocity of the fluid composition in the flow passage, wherein the majority of the fluid composition enters the chamber via one of multiple inlets, and wherein the one of the multiple inlets is selected based on the velocity.

30. The system of claim 29, wherein a first one of the multiple inlets directs the fluid composition to flow more directly toward an outlet of the chamber as compared to a second one of the multiple inlets.

31. The system of claim 30, wherein the first inlet directs the fluid composition to flow more radially relative to the outlet as compared to the second inlet.

32. The system of claim 30, wherein the second inlet directs the fluid composition to spiral more about the outlet as compared to the first inlet.

33. A variable flow resistance system for use in a subterranean well, the variable flow resistance system comprising:

a flow chamber having an outlet, and at least first and second inlets, wherein a fluid composition flowing through a flow passage is divided into at least first and second portions respectively entering the chamber via the first and second inlets based on at least one of a) viscosity of the fluid composition in the flow passage, b) velocity of the fluid composition in the flow passage, c) density of the fluid composition in the flow passage, and d) a ratio of desired fluid to undesired fluid in the fluid composition, and wherein flow of the second portion of the fluid composition which enters the flow chamber via the second inlet opposes flow of the first portion of the fluid composition which enters the flow chamber via the first inlet, whereby a resistance to flow of the fluid composition through the flow chamber varies with a ratio of flows through the first and second inlets.

34. The system of claim 33, wherein a resistance to flow of the fluid composition through the flow chamber decreases as flow through the first and second inlets becomes more equal.

35. The system of claim 34, wherein flow through the first and second inlets becomes more equal as a viscosity of the fluid composition increases.

36. The system of claim 34, wherein flow through the first and second inlets becomes more equal as a velocity of the fluid composition decreases.

37. The system of claim 34, wherein flow through the first and second inlets becomes more equal as a density of the fluid composition decreases.

38. The system of claim 34, wherein flow through the first and second inlets becomes more equal as a ratio of desired fluid to undesired fluid in the fluid composition increases.

39. The system of claim 33, wherein a resistance to flow of the fluid composition through the flow chamber increases as flow through the first and second inlets becomes less equal.

40. The system of claim 33, wherein the fluid composition flows to the first inlet via a first flow passage which is oriented generally tangential to the flow chamber, and wherein the fluid composition flows to the second inlet via a second flow passage which is oriented generally tangential to the flow chamber.

41. The system of claim 40, wherein the second passage receives the fluid composition from a branch of the first flow passage.

42. A variable flow resistance system for use in a subterranean well, the variable flow resistance system comprising:

a flow chamber having an outlet, and at least first and second inlets, wherein a fluid composition which enters the flow chamber via the second inlet opposes flow of the fluid composition which enters the flow chamber via the first inlet, whereby a resistance to flow of the fluid composition through the flow chamber varies with a ratio of flows through the first and second inlets, wherein a resistance to flow of the fluid composition through the flow chamber decreases as flow through the first and second inlets becomes more equal, and wherein flow through the first and second inlets becomes more equal as a viscosity of the fluid composition increases.

43. A variable flow resistance system for use in a subterranean well, the variable flow resistance system comprising:

a flow chamber having an outlet, and at least first and second inlets, wherein a fluid composition which enters the flow chamber via the second inlet opposes flow of the fluid composition which enters the flow chamber via the first inlet, whereby a resistance to flow of the fluid composition through the flow chamber varies with a ratio of flows through the first and second inlets, wherein a resistance to flow of the fluid composition through the flow chamber decreases as flow through the first and second inlets becomes more equal, and wherein flow through the first and second inlets becomes more equal as a density of the fluid composition decreases.

* * * * *